US010001035B2

(12) United States Patent
Cecil et al.

(10) Patent No.: US 10,001,035 B2
(45) Date of Patent: Jun. 19, 2018

(54) HYDRAULIC LASH ADJUSTER

(71) Applicant: CUMMINS INC., Columbus, IN (US)

(72) Inventors: Adam C. Cecil, Columbus, IN (US); David M. Barnes, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days. days.

(21) Appl. No.: 15/545,933

(22) PCT Filed: Mar. 14, 2017

(86) PCT No.: PCT/US2017/022329
§ 371 (c)(1),
(2) Date: Jul. 24, 2017

(87) PCT Pub. No.: WO2017/160859
PCT Pub. Date: Sep. 21, 2017

(65) Prior Publication Data

US 2018/0119579 A1 May 3, 2018

Related U.S. Application Data

(60) Provisional application No. 62/310,213, filed on Mar. 18, 2016.

(51) Int. Cl.
*F01L 1/24* (2006.01)
*F01L 1/18* (2006.01)
(Continued)

(52) U.S. Cl.
CPC ..... *F01L 1/24* (2013.01); *F01L 1/181* (2013.01); *F01L 1/2405* (2013.01); *F01L 1/267* (2013.01); *F01L 1/46* (2013.01); *F01L 2103/00* (2013.01)

(58) Field of Classification Search
CPC . F01L 1/181; F01L 1/24; F01L 1/2405; F01L 1/2411; F01L 1/2416; F01L 1/2422; F01L 1/46
(Continued)

(56) References Cited

U.S. PATENT DOCUMENTS 6,148,780 A 11/2000 O'Neill
6,718,946 B2 4/2004 Hokazono
(Continued)

FOREIGN PATENT DOCUMENTS

DE 102012200754 7/2013

OTHER PUBLICATIONS

International Search Report and Written Opinion issued by the International Searching Authority, dated Jun. 8, 2017, for International Application No. PCT/US2017/22329; 7 pgs.

*Primary Examiner* — Jorge Leon, Jr.
(74) *Attorney, Agent, or Firm* — Faegre Baker Daniels LLP

(57) ABSTRACT

An eccentric hydraulic lash adjuster, a combustion engine comprising the eccentric hydraulic lash adjuster, and a method of assembling the combustion engine, the combustion engine including a rocker lever having a nose at a distal end thereof, and a bridge bar extending between two valves, the rocker lever configured to apply pressure on the bridge bar to actuate the two valves, and an eccentric hydraulic lash adjuster positioned in the nose of the rocker lever; and a fuel injector adjacent to the nose of the rocker lever and the bridge bar, wherein the eccentric hydraulic lash adjuster includes a housing having a pivot point and a longitudinal axis offset from the pivot point and is configured to pivot about the pivot point when the rocker lever pivots about the rocket lever shaft, wherein the offset is dimensioned to prevent interference between the nose and the fuel injector.

30 Claims, 6 Drawing Sheets

(51) Int. Cl.
*F01L 1/26* (2006.01)
*F01L 1/46* (2006.01)

(58) Field of Classification Search
USPC ..... 123/90.46
See application file for complete search history.

(56) References Cited

U.S. PATENT DOCUMENTS

| | | | | |
|---|---|---|---|---|
| RE39,258 | E | 9/2006 | Cosma | |
| 8,667,939 | B2 | 3/2014 | Barnes | |
| 8,789,502 | B2 | 7/2014 | Barnes | |
| 9,200,541 | B2 | 12/2015 | Roberts | |
| 2002/0069846 | A1 | 6/2002 | Kunz | |
| 2009/0159028 | A1* | 6/2009 | Douse | F01L 1/185 123/90.46 |
| 2011/0056447 | A1 | 3/2011 | Astner | |
| 2015/0122220 | A1 | 5/2015 | Cecur | |
| 2015/0159520 | A1 | 6/2015 | Cecur | |

* cited by examiner

HYDRAULIC LASH ADJUSTER

CROSS-REFERENCE TO RELATED APPLICATIONS

This is a § 371 application of International Patent Application No. PCT/US2017/22329, filed Mar. 14, 2017, which claims the benefit of U.S. Patent Application No. 62/310,213 titled "HYDRAULIC LASH ADJUSTER", filed Mar. 18, 2016, the disclosures of both applications incorporated herein in their entirety by reference.

FIELD OF THE DISCLOSURE

The disclosure relates to combustion engines with hydraulic lash adjusters.

BACKGROUND OF THE DISCLOSURE

A hydraulic lash adjuster (HLA) eliminates clearance (lash) between a valve and its rocker lever while permitting thermal expansion and preventing or attenuating noise generated by movement due to the clearance. As diesel engines are improved to reduce their noise, vibration and harshness (NVH) signatures, valve train noise is becoming more apparent.

However, as the space between valves and fuel injectors decreases, it becomes increasingly more difficult to mount the HLAs without interference with the fuel injectors. There is a need, therefore, for an improved combustion engine with a reduced NVH signature.

SUMMARY OF CLAIMED EMBODIMENTS

An eccentric hydraulic lash adjuster, a combustion engine comprising the eccentric hydraulic lash adjuster, and a method of assembling the combustion engine, are provided. The eccentric hydraulic lash adjuster has an offset dimensioned to prevent interference between the nose of a rocker lever and the fuel injector.

In some embodiments, an eccentric hydraulic lash adjuster (80) comprises a housing (82) having a pivot point (85) and a longitudinal axis (67) offset from a line parallel to the longitudinal axis and passing through the pivot point (85), wherein the offset is greater than 0.0 millimeters (mm).

In some embodiments, a valve train assembly (10) comprises an eccentric hydraulic lash adjuster (80) that comprises a housing (82) having a pivot point (85) and a longitudinal axis (67) offset from a line parallel to the longitudinal axis and passing through the pivot point (85), wherein the offset is greater than 0.0 millimeters (mm), and further comprises two valves (40, 42); a rocker lever shaft (20); a rocker lever (12, 14) structured to pivot about the rocket lever shaft (20) and having a nose (30, 32) at a distal end thereof; and a bridge bar (54, 56) extending between the two valves (40, 42), the rocker lever (12, 14) configured to apply pressure on the bridge bar (54, 56) to actuate the two valves (40, 42), the eccentric hydraulic lash adjuster (80) positioned in the nose (30, 32) of the rocker lever (12, 14).

In some embodiments, a combustion engine comprises a valve train assembly (10) comprising an eccentric hydraulic lash adjuster (80) that comprises a housing (82) having a pivot point (85) and a longitudinal axis (67) offset from a line parallel to the longitudinal axis and passing through the pivot point (85), wherein the offset is greater than 0.0 millimeters (mm), the valve train assembly (10) further comprising two valves (40, 42); a rocker lever shaft (20); a rocker lever (12, 14) structured to pivot about the rocket lever shaft (20) and having a nose (30, 32) at a distal end thereof; and a bridge bar (54, 56) extending between the two valves (40, 42), the rocker lever (12, 14) configured to apply pressure on the bridge bar (54, 56) to actuate the two valves (40, 42), the eccentric hydraulic lash adjuster (80) positioned in the nose (30, 32) of the rocker lever (12, 14), and the combustion engine further comprises a fuel injector (44) adjacent to the nose (30, 32) of the rocker lever (12, 14) and the bridge bar (54, 56), wherein the offset is positioned and dimensioned to prevent interference between the nose (30, 32) and the fuel injector (44) during operation of the combustion engine. An embodiment of a method of making the combustion engine comprises mounting the two valves (40, 42) adjacent the fuel injector (44); mounting the rocker lever (12, 14) on the rocker lever shaft (20), which is structured to enable the rocker lever (12, 14) to pivot about the rocket lever shaft (20); inserting the eccentric hydraulic lash adjuster (80) in the nose (30, 32); placing the bridge bar (54, 56) over the two valves (40, 42); and positioning the rocker lever (12, 14) with the nose (30, 32) over the bridge bar (54, 56) adjacent the fuel injector (44).

In some embodiments, a method of making a combustion engine comprises mounting two valves (40, 42) adjacent a fuel injector (44); mounting a rocker lever (12, 14) on a rocker lever shaft (20) structured to enable the rocker lever (12, 14) to pivot about the rocket lever shaft (20), the rocker lever (12, 14) having a nose (30, 32) at a distal end thereof; inserting an eccentric hydraulic lash adjuster (80) in the nose (30, 32), the eccentric hydraulic lash adjuster (80) including a pivot point (85) offset from a longitudinal axis (67) of the eccentric hydraulic lash adjuster (80); placing a bridge bar (54, 56) over the two valves (40, 42); and positioning the rocker lever (12, 14) with the nose (30, 32) over the bridge bar (54, 56) adjacent the fuel injector (44), wherein the offset is dimensioned to prevent interference between the nose (30, 32) and the fuel injector (44) during operation of the combustion engine, whereby without the offset the nose (30, 32) would interfere with the fuel injector (44) during operation of the combustion engine.

BRIEF DESCRIPTION OF THE DRAWINGS

The above-mentioned and other disclosed features, the manner of attaining them, and the advantages thereof will become more apparent and will be better understood by reference to the following description of disclosed embodiments taken in conjunction with the accompanying drawings, wherein.

Figure 1:
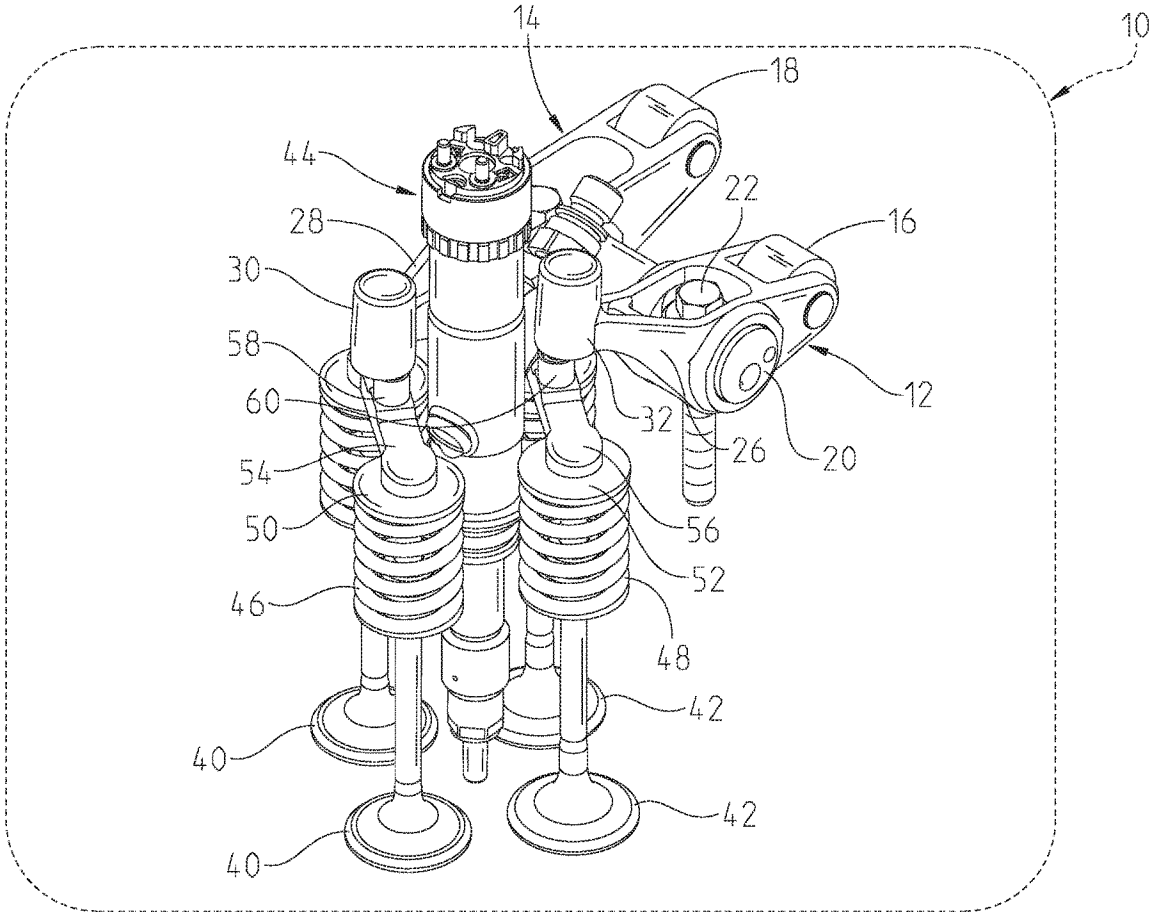
FIG. 1 is a perspective view of a valve train assembly.

Corresponding reference characters indicate corresponding parts throughout the several views. Although the drawings represent embodiments of various features and components according to the present invention, the drawings are not necessarily to scale and certain features may be exaggerated in order to better illustrate and explain the present invention. The exemplification set out herein illustrates embodiments of the invention, and such exemplifications are not to be construed as limiting the scope of the invention in any manner.

DETAILED DESCRIPTION

For the purposes of promoting an understanding of the principles of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrated devices and described methods and further applications of the principles of the invention which would normally occur to one skilled in the art to which the invention relates.

A combustion engine comprises a head removably mounted on a block. The block includes combustion cylinders and pistons moving longitudinally therein. A valve train assembly comprises valves and components configured to actuate the valves, to enable gases to flow into and out of the combustion cylinders synchronized by a crankshaft of the combustion engine. A valve train assembly will be described with reference to FIGS. 1-3. HLAs are mounted in rocker levers of the valve train assembly.

An HLA comprises a cylinder encasing a piston that is held at the outer limit of its travel by a spring. The HLA is supported by the rocker lever. The cylinder fills with oil when the rocker lever in a neutral position. A check-valve prevents drainage of the oil as the rocker lever pivots during the lift phase of the camshaft's travel, maintaining the piston in position. The load is then reduced as the camshaft rotates, and the internal spring returns the piston to its neutral state so that any oil leaked out of the cylinder is replaced. The small range of travel of the piston is enough to eliminate the lash adjustment.

The HLA is traditionally supported by the rocker lever between its distal end and the shaft upon which the rocker lever pivots, which is generally a low inertia portion of the lever arm. In small engines or engines with a large number of fuel injectors and valves, there may not be enough space to add HLAs in the traditional location. The HLA could be mounted at the distal end, or nose, of the rocker lever, over the valve. But over-valve mounting requires a rocker lever for each valve, which requires additional space and increases costs, and which undesirably increases the inertia of the rocker assembly.

A bridge bar can be placed over two valves such that one rocker lever can actuate both valves. The HLA can then be positioned over the bridge bar, and one rocker lever can thus actuate two valves. But the nose of the rocker lever, which holds the HLA, can interfere with the fuel injector, which is positioned between the valves. For example, the minimum distance between the bridge bar and the fuel injector will be defined by the width of the nose of the bridge bar. If the bridge bar is positioned closer to the fuel injector than said minimum distance, the nose will interfere with the fuel injector. The inventors developed an HLA with an offset pivot point, referred to as an eccentric HLA or EHLA. The offset permits the EHLA to apply force at the center of the bridge bar, thus preventing lateral tilting of the bridge bar, and at the same time enables placement of the bridge bar (and the valves) closer to the fuel injector than is possible without the offset, thereby permitting addition of EHLAs to engines where use of HLAs is otherwise not possible without other means that require more parts and increase cost.

FIG. 1 is a perspective view of a valve train assembly 10 comprising an intake rocker lever 12 and an exhaust rocker lever 14. The rocker levers interface with the camshaft (not shown) via camshaft rollers 16 and 18. The camshaft causes rocker levers 12, 14 to pivot around a rocker lever shaft 20 which is constrained by mounting bolts 22. Rocker levers 12 and 14 include noses 30 and 32 extending from arms 26 and 28 and each receiving an EHLA 80 (shown in FIG. 3). Pairs of exhaust valves 40 and intake valves 42 surround a fuel injector 44. The valves are constrained in the head (not shown) by exhaust valve springs 46 and intake valve springs 48. The valve springs are constrained by valve retainers 50, 52. Bridge bars 54, 56 actuate, respectively, exhaust valves 40 and intake valves 42.

Figure 2:
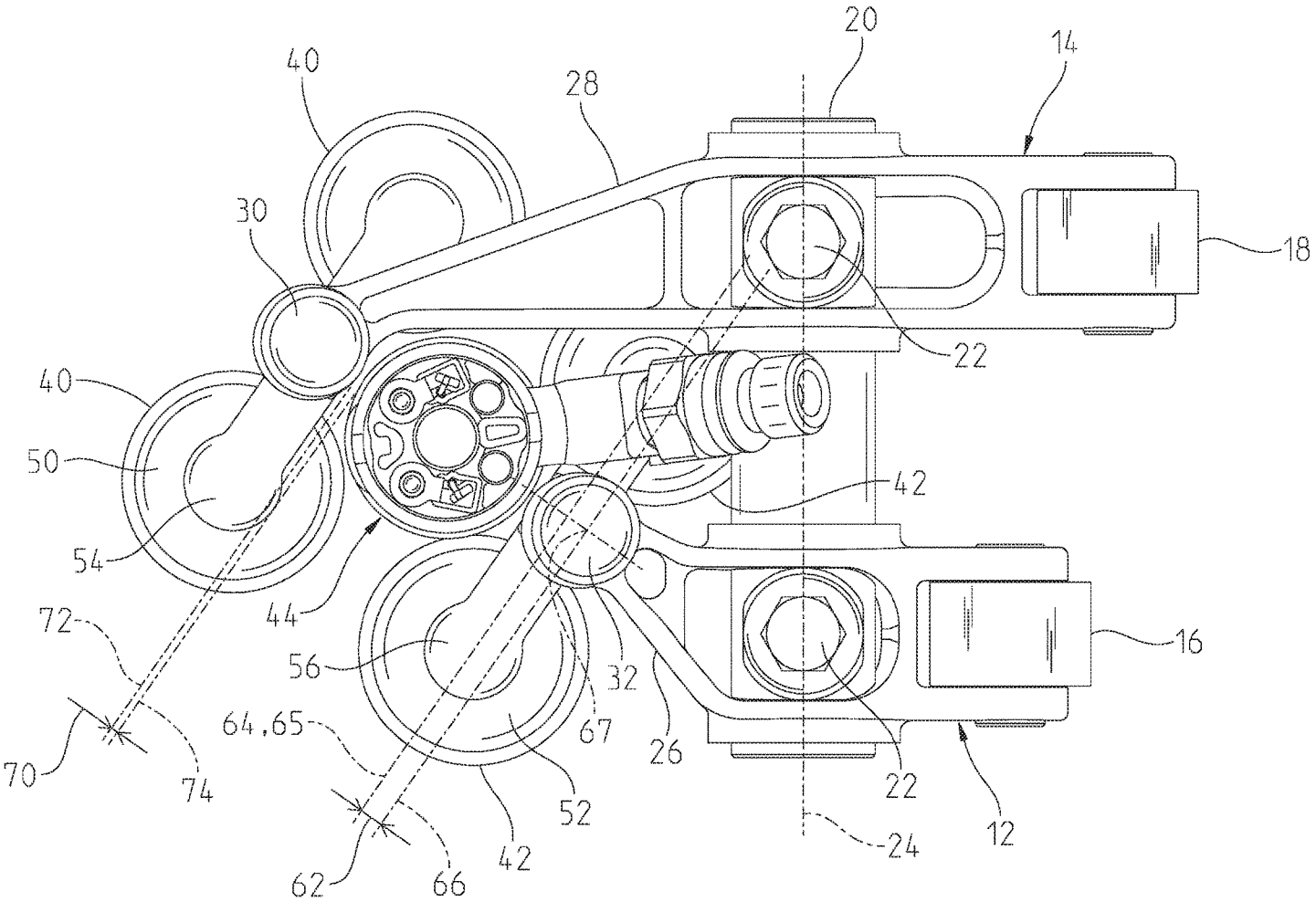
FIG. 2 is a top plan view of the valve train assembly of FIG. 1.
Figure 3:
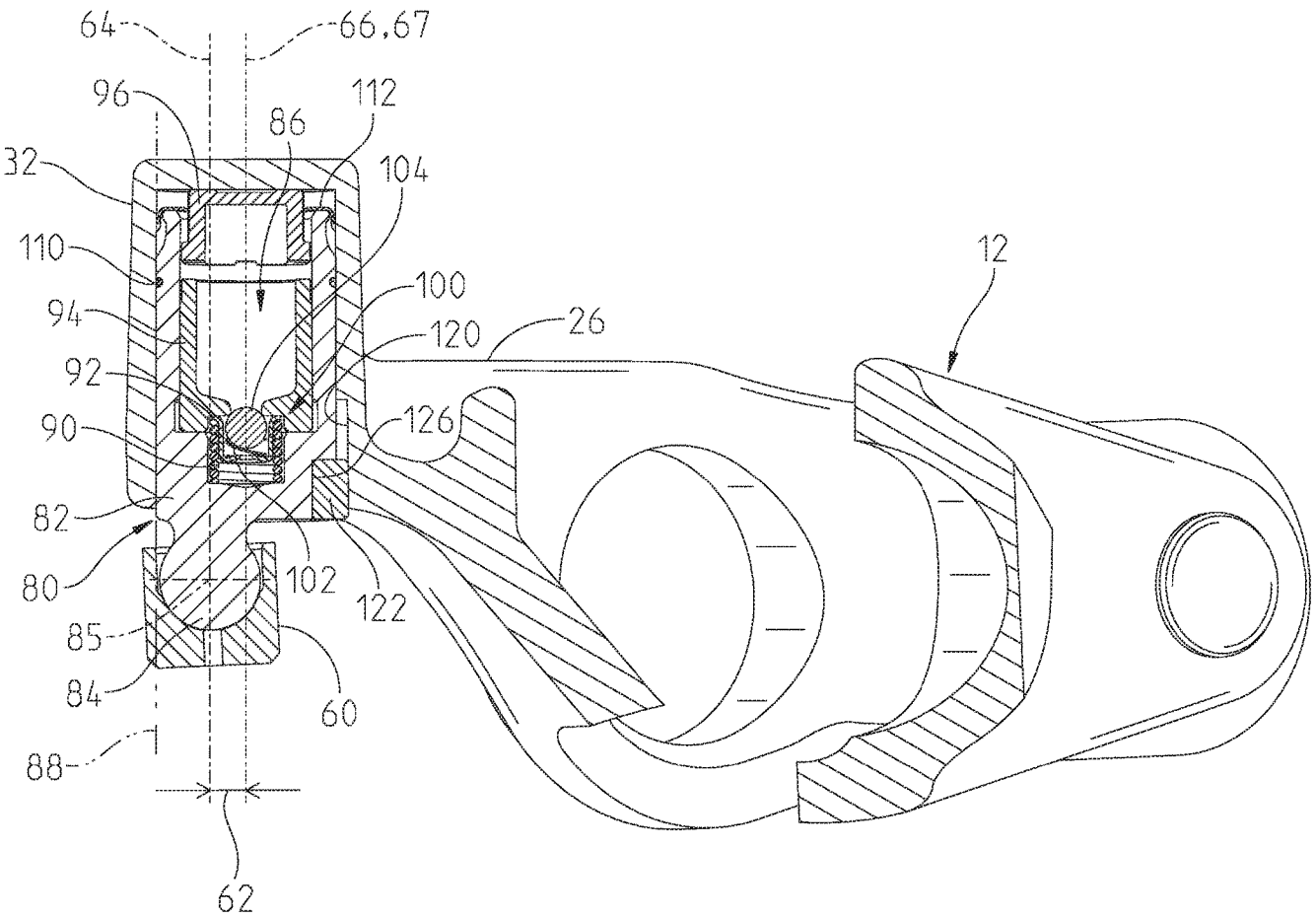
FIG. 3 is a perspective partially section view of the valve train assembly of FIG. 1.

As shown in FIG. 2, an HLA offset 62 (best seen in FIG. 3) is defined as the shortest distance between a pivot point 85 (shown in FIG. 3) of EHLA 80 and a longitudinal axis 67 of EHLA 80, shown also as the distance between two parallel planes, denoted by numerals 64 and 66. HLA offset 62 is greater than 0.0 mm and creates the required clearance between the nose 30, 32 of rocker lever 12, 14 and fuel injector 44. Plane 64 comprises a longitudinal axis 65 of bridge bar 54, 56. In the present embodiment pivot point 85 extends perpendicularly to and above the center of bridge bar 54, 56, denoted as numeral 68 in FIG. 5. Center 68 is located on longitudinal axis 65. However in variations of the present embodiment pivot point 85 is offset from center 68, as described with reference to FIG. 6. Without HLA offset 62 the nose of the rocker lever would interfere with fuel injector 44. Another eccentric EHLA 80 is located over exhaust bridge bar 54. Elephant feet 58 and 60, discussed with reference to FIG. 3, are provided between EHLAs 80 and bridge bars 54 and 56, respectively. Preferably, a nose clearance gap of at least 2.0 mm, denoted by numeral 70 and defined by parallel planes 72 and 74, exists between the nose 30, 32 of the rocker lever and fuel injector 44. More preferably, nose clearance gap 70 is at least about 2.5 mm. Even more preferably, nose clearance gap 70 is at least 3 mm. Planes 72 and 74 are planes tangential to the external surface of nose 30, 32 at its widest point and the external surface of fuel injector 44 adjacent to nose 30, 32 at its widest point. Thus, nose clearance gap 70 represents the shortest distance between the external surface of nose 30, 32 and the external surface of fuel injector 44 adjacent nose 30, 32. A numeral 67 denotes a longitudinal axis, or centerline, of EHLA 80. In one example, HLA offset 62 is between about 1.0 and 10.0 mm. In another example, HLA offset 62 is greater than about 1.0 mm. In a further example, HLA offset 62 is between about 2.0 and 6.0 mm.

Referring to FIG. 3, EHLA 80 comprises a housing 82, an inner housing 96, a plunger 94, an oil reservoir 86, and a check-valve 100 comprising a valve ball 104, a valve cap 92, a valve spring 102, and a return spring 90. A seal 110 and cap 112 are also shown. A pivot ball 84 extends from housing 82. In the present embodiment, the pivot point is the center point of pivot ball 84, denoted by numeral 85. Elephant foot 60 provides a flat interface to bridge bar 54, 56. Plane 66 passes through the longitudinal axis of housing 82 and bisects nose 32, and plane 64 passes through pivot point 85, is parallel to plane 66, and bisects the bridge bar along its longitudinal direction. The force applied by the rocker lever to the valve is applied through pivot ball 84. In one example, plane 64 passes through a longitudinal centerline of the bridge bar, to prevent tilting of the bridge bar. In this example, HLA offset 62 is perpendicular to the bridge bar. But plane 64 can be slightly off-center relative to the bridge bar so long as the action of the bridge bar is not impeded. Housing 82 is aligned in a predetermined orientation in nose 32, such that HLA offset 62 is properly oriented relative to the rocker lever and the bridge bar. In one example, HLA offset 62 is properly oriented when it is oriented substantially perpendicularly to the longitudinal centerline of the bridge bar. In another example, HLA offset 62 is properly oriented when it is oriented at most 15 degrees off perpendicular. In one example, shown in FIG. 3, a locating pin 122 is inserted into a gap formed by a cut-out 120 made in nose 32 and a cut-out 126 made in housing 82, to maintain the correct alignment of eccentric EHLA 80 within nose 32. In another example a key is formed on one of housing 82 and nose 32, and a mating slot is formed in the other, to properly align eccentric EHLA 80 within nose 32.

Figure 4:
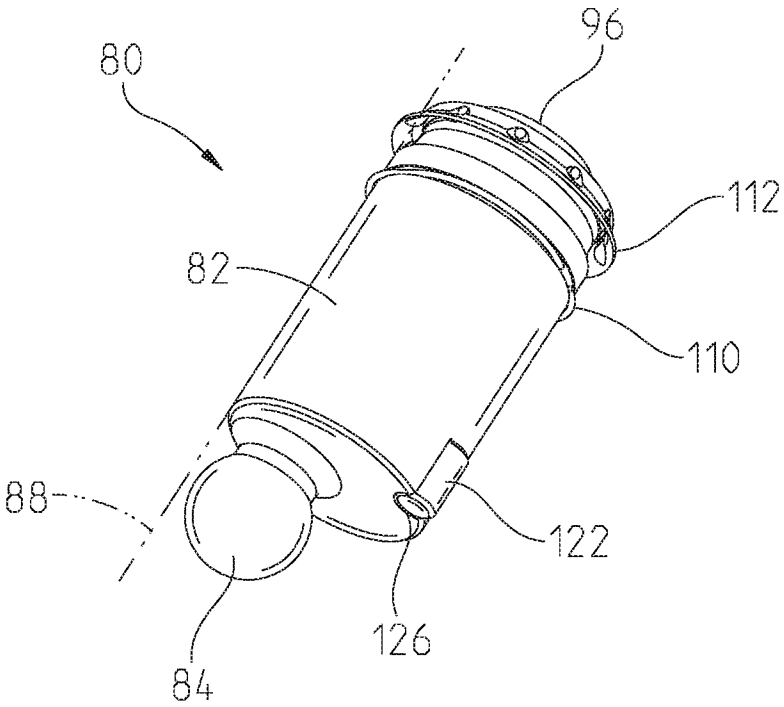
FIG. 4 is a perspective view of an eccentric hydraulic lash adjuster.

As shown in FIGS. 3 and 4, pivot ball 84 extends within a projection of the external longitudinal perimeter of housing 82 (e.g. at most to line 88). Housing 82 may be cut from stock bar, such that the diameter of the stock bar substantially matches the diameter of the cylindrical portion of housing 82 located in a cylindrical cavity in nose 32, to limit the amount of cutting to essentially just cutting pivot ball 84 from the stock bar, which reduces waste and labor. Of course, housing 82 may be cut from larger stock bar or produced by other manufacturing methods so as to produce a larger offset.

Figure 5:
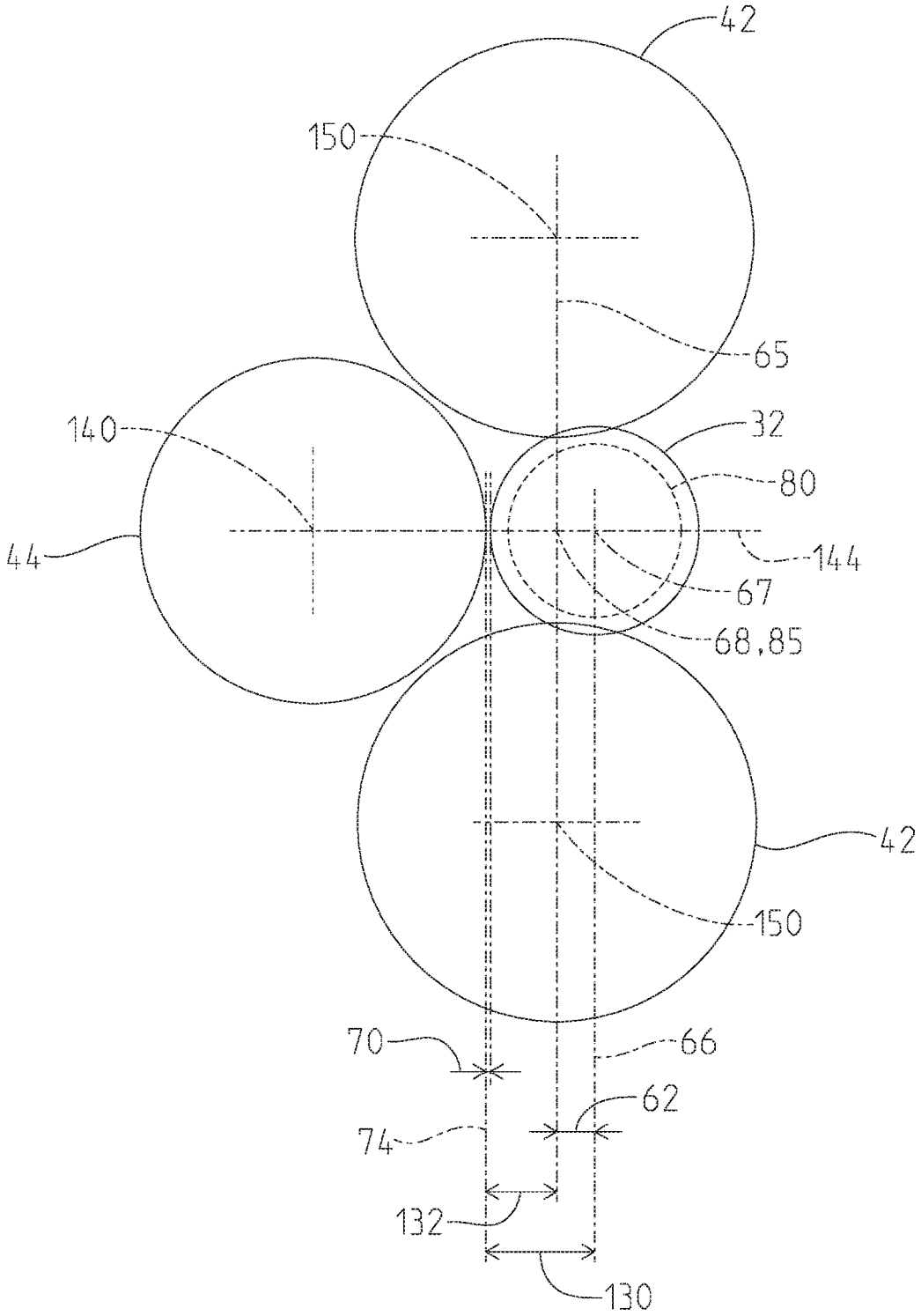
FIG. 5 is a schematic view of the position of the eccentric hydraulic lash adjuster relative to a fuel injector according to some disclosed embodiments.

Referring now to FIG. 5, therein is shown a schematic representation of one embodiment of valve train assembly 10 in which HLA offset 62 is perpendicular to axis 65, which traverses longitudinal axis 150 of valve 42, and is parallel with a line 144 passing through center 68 of bridge bar 54, 56 and the longitudinal axis 140 of fuel injector 44. Axis 67 traverses line 144 in the present embodiment. The shortest distance 130 from longitudinal axis 67 of housing 82 to fuel injector 44 is greater than the shortest distance 132 from fuel injector 44 to longitudinal axis 65 of bridge bar 54, 56. In a variation thereof, the shortest distance 130 from longitudinal axis 67 of housing 82 to fuel injector 44 is greater than the shortest distance 132 from fuel injector 44 to a line traversing axes 150 of valves 42. In the present embodiment, pivot point 85 is positioned substantially equidistantly between the axes 150 of valves 40, 42 coupled to the respective bridge bars, which may be referred to as being longitudinally centered. In the present embodiment, pivot point 85 traverses a line traversing the axes 150 of valves 40, 42, which may be referred to as being radially centered.

In some embodiments, HLA offset 62 is not perpendicular to axis 65 or parallel with line 144. For example, HLA offset 62 may be disposed at an angle greater than 0 degrees and up to and including 15 degrees. Accordingly, pivot point 85 remains on axis 65 but axis 67 does not traverse line 144. A line passing through axis 85 and axis 67 is therefore at an angle, referred to as the HLA offset angle, of not more than 15 degrees to line 144. This arrangement may be desirable to enable use of rocker levers of various shapes.

In, some embodiments pivot point 85 does not traverse axis 65 and is instead translated from axis 65. The amount of translation should be limited to prevent destabilizing bridge bar 54, 56 or creating timing or torque differences in relation to the valves operably coupled to bridge bar 54, 56, which negatively affect operation of valve train assembly 10. The translation may be along the length of bridge bar 54, 56 or along its width, or along both. In other words, pivot point 85 may be offset in any direction from the center 68 of bridge bar 54, 56. The amount of offset in relation to the center of bridge bar 54, 56 may be based on various factors including dimensions of the various components.

Figure 6:
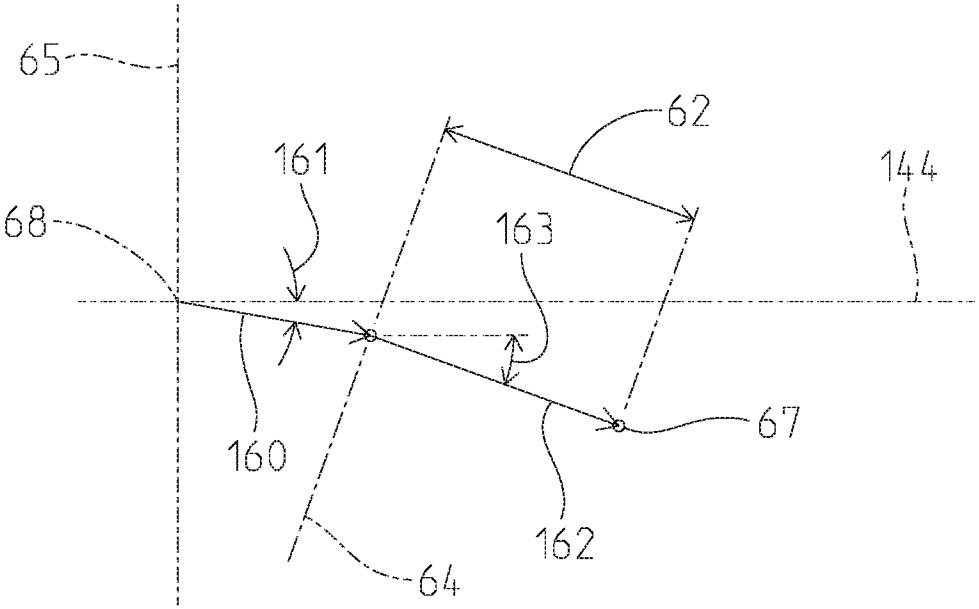
FIG. 6 is a schematic view of the offset position and orientation of the eccentric hydraulic lash adjuster relative to the fuel injector according to some disclosed embodiments.

Referring to FIG. 6, therein is shown a vector 160 extending from center 68 to plane 64 (comprising pivot point 85) and perpendicular to plane 64. Vector 160 illustrates that pivot point 85 may be translated in any direction, represented by an angle 161, relative to center 68. A vector 162, disposed at an angle 163 to line 144, illustrates that EHLA 80, and HLA offset 62, may be oriented in any direction relative to center 68. Vector 162 extends from plane 64 to axis 67 and perpendicular to plane 64.

As used herein, the transitional term "comprising", which is synonymous with "including," or "containing," is inclusive or open-ended and does not exclude additional, unspecified elements or method steps. By contrast, the transitional term "consisting" is a closed term which does not permit addition of unspecified terms.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

We claim:

1. An eccentric hydraulic lash adjuster comprising:

a housing having a pivot point and a longitudinal axis offset from a line parallel to the longitudinal axis and passing through the pivot point, wherein the offset is greater than 0.0 millimeters (mm).

2. The eccentric hydraulic lash adjuster of claim 1, wherein the housing comprises a pivot ball having a center comprising the pivot point.

3. The eccentric hydraulic lash adjuster of claim 1, wherein the housing comprises a cylindrical cavity and the longitudinal axis comprises an axis of the cylindrical cavity.

4. The eccentric hydraulic lash adjuster of claim 1, wherein the offset is equal to or greater than 1.0 mm.

5. The eccentric hydraulic lash adjuster of claim 1, wherein the offset is equal to or greater than 2.0 mm.

6. The eccentric hydraulic lash adjuster of claim 1, wherein the offset is between and including 1.0 mm and 10.0 mm.

7. The eccentric hydraulic lash adjuster of claim 1, wherein the offset is between and including 2.0 mm and 6.0 mm.

8. A valve train assembly comprising:

an eccentric hydraulic lash adjuster including a housing having a pivot point and a longitudinal axis with an offset from a line parallel to the longitudinal axis and passing through the pivot point, wherein the offset is greater than 0.0 millimeters (mm);

two valves;

a rocker lever shaft;

a rocker lever structured to pivot about the rocket lever shaft and having a nose at a distal end thereof; and a bridge bar extending between the two valves, the rocker lever configured to apply pressure on the bridge bar to actuate the two valves, the eccentric hydraulic lash adjuster positioned in the nose of the rocker lever.

9. The valve train assembly of claim 8, wherein the valve train assembly is sized and configured to have a nose clearance gap of at least 2.0 millimeters.

10. The valve train assembly of claim 9, wherein the nose clearance gap is at least 2.5 millimeters.

11. The valve train assembly of claim 8, wherein the offset is measured along a horizontal plane passing through the pivot point and being perpendicular to the longitudinal axis.

12. A combustion engine comprising:

a valve train assembly including:

an eccentric hydraulic lash adjuster including a housing having a pivot point and a longitudinal axis with an offset from a line parallel to the longitudinal axis and passing through the pivot point, wherein the offset is greater than 0.0 millimeters (mm);

two valves;

a rocker lever shaft;

a rocker lever structured to pivot about the rocket lever shaft and having a nose at a distal end thereof; and a bridge bar extending between the two valves, the rocker lever configured to apply pressure on the bridge bar to actuate the two valves, the eccentric hydraulic lash adjuster positioned in the nose of the rocker lever; and a fuel injector adjacent to the nose of the rocker lever and the bridge bar, wherein the offset is positioned and dimensioned to prevent interference between the nose and the fuel injector during operation of the combustion engine.

13. The combustion engine of claim 12, wherein the offset comprises an offset distance of at least 1.0 millimeters.

14. The combustion engine of claim 13, wherein the offset distance is at least 2.0 millimeters.

15. The combustion engine of claim 14, wherein the valve train assembly is sized and configured to have a nose clearance gap of at least 2.0 millimeters.

16. The combustion engine of claim 15, wherein the nose clearance gap is at least 2.5 millimeters.

17. The combustion engine of claim 12, wherein the offset is measured along a horizontal plane passing through the pivot point and being perpendicular to the longitudinal axis.

18. The combustion engine of claim 12, wherein the housing comprises a pivot ball having a center comprising the pivot point.

19. The combustion engine of claim 12, wherein the eccentric hydraulic lash adjuster is positioned at an angle of between −15 and 15 degrees relative to a line traversing the center of the bridge bar and an axis of the fuel injector.

20. The combustion engine of claim 12, wherein a shortest distance from the longitudinal axis of the housing to the fuel injector is greater than a shortest distance from the fuel injector to a center of the bridge bar.

21. The combustion engine of claim 12, wherein a longitudinal axis of the bridge bar is perpendicular to a line traversing a line passing through the pivot point that is parallel to the longitudinal axis of the housing.

22. The combustion engine of claim 21, wherein the bridge bar is operably coupled to the two valves, and the longitudinal axis of the bridge bar traverses longitudinal axes of the two valves to which the bridge bar is operably coupled.

23. The combustion engine of claim 21, wherein the pivot point is horizontally offset from a center of the bridge bar along a horizontal plane perpendicular to a longitudinal axis of the fuel injector.

24. A method of making a combustion engine comprising a valve train assembly including an eccentric hydraulic lash adjuster including a housing having a pivot point and a longitudinal axis with an offset from a line parallel to the longitudinal axis and passing through the pivot point, wherein the offset is greater than 0.0 millimeters (mm), two valves, a rocker lever shaft, a rocker lever structured to pivot about the rocket lever shaft and having a nose at a distal end thereof, and a bridge bar extending between the two valves, the rocker lever configured to apply pressure on the bridge bar to actuate the two valves, the eccentric hydraulic lash adjuster positioned in the nose of the rocker lever, and a fuel injector adjacent to the nose of the rocker lever and the bridge bar, the method comprising:

mounting the two valves adjacent the fuel injector;

mounting the rocker lever on the rocker lever shaft, which is structured to enable the rocker lever to pivot about the rocket lever shaft;

inserting the eccentric hydraulic lash adjuster in the nose;

placing the bridge bar over the two valves; and positioning the rocker lever with the nose over the bridge bar adjacent the fuel injector.

25. The method of claim 24, wherein the offset is dimensioned to prevent interference between the nose and the fuel injector during operation of the combustion engine, whereby without the offset the nose would interfere with the fuel injector during operation of the combustion engine.

26. The method of claim 24, wherein the offset is at least 1.0 millimeters.

27. The method of claim 26, wherein the offset is at least 2.0 millimeters.

28. A method of making a combustion engine, the method comprising:

mounting two valves adjacent a fuel injector;

mounting a rocker lever on a rocker lever shaft structured to enable the rocker lever to pivot about the rocket lever shaft, the rocker lever having a nose at a distal end thereof;

inserting an eccentric hydraulic lash adjuster in the nose, the eccentric hydraulic lash adjuster including a pivot point offset from a longitudinal axis of the eccentric hydraulic lash adjuster;

placing a bridge bar over the two valves; and positioning the rocker lever with the nose over the bridge bar adjacent the fuel injector, wherein the offset is dimensioned to prevent interference between the nose and the fuel injector during operation of the combustion engine, whereby without the offset the nose would interfere with the fuel injector during operation of the combustion engine.

29. The method of claim 28, wherein the offset is at least 1.0 millimeters.

30. The method of claim 29, wherein the offset is at least 2.0 millimeters.

* * * * *